US006071471A

United States Patent [19]

Winston

[11] Patent Number: 6,071,471

[45] Date of Patent: Jun. 6, 2000

[54] COMPOSITION FOR JEWELRY

[75] Inventor: Ronald Winston, Scarsdale, N.Y.

[73] Assignee: Harry Winston Inc., New York, N.Y.

[21] Appl. No.: 09/173,529

[22] Filed: Oct. 15, 1998

Related U.S. Application Data

[63] Continuation-in-part of application No. 09/127,512, Jul. 31, 1998, abandoned.

[60] Provisional application No. 60/054,361, Jul. 31, 1997.

[51] Int. Cl.[7] ..... C22C 5/04

[52] U.S. Cl. ..... 420/467; 148/430

[58] Field of Search ..... 420/467; 148/430

[56] References Cited

U.S. PATENT DOCUMENTS

| | | |
|---|---|---|
| 3,767,391 | 10/1973 | Tuccillo et al. . |
| 3,884,669 | 5/1975 | Friend . |
| 3,958,070 | 5/1976 | Schintlmeister et al. . |
| 4,130,506 | 12/1978 | Collier et al. . |
| 4,192,667 | 3/1980 | Chrisman . |
| 4,240,847 | 12/1980 | Chrisman . |
| 4,274,877 | 6/1981 | Collier et al. . |
| 4,439,470 | 3/1984 | Sievers . |
| 4,464,213 | 8/1984 | Nielsen . |
| 5,164,026 | 11/1992 | Muller . |
| 5,240,172 | 8/1993 | Steinke et al. . |

OTHER PUBLICATIONS

Chem. Abstract (105:157438) JP 61034138, Feb. 18, 1986.

*Primary Examiner*—Deborah Yee
*Attorney, Agent, or Firm*—William Squire

[57] ABSTRACT

A platinum alloy has a white finish and comprises platinum, rhodium and ruthenium, with the platinum being present at a concentration of about 95% by weight, the rhodium being present at a concentration from about 2.5% to about 3.5% by weight, with increasing whiteness and workability at 3.5% Rh, and the ruthenium being present at a concentration correspondingly from about 1.5% to about 2.5% by weight, with the preferred composition being at about 1.5% by weight. In addition, methods of preparing the alloy and aesthetic items made with the alloy are included.

7 Claims, 3 Drawing Sheets

COMPOSITION FOR JEWELRY

This application is a continuation-in-part of application Ser. No. 09/127,512 filed Jul. 31, 1998, abandoned, which is a complete application of provisional application 60/054,361 filed Jul. 31, 1997.

FIELD OF THE INVENTION

This invention relates to metal alloy compositions useful in the manufacture of jewelry and a method of manufacture of the metal alloy composition.

BACKGROUND OF THE INVENTION

Alloys of platinum are used in the jewelry art for the fabrication of settings for precious and semi-precious gemstones. Desired properties, as recognized by the present inventor, include surface whiteness, malleability, strength, durability along with tarnish- and corrosion-resistance and ease of fabrication. The prior art includes alloys with one or more of these characteristics, but not an alloy possessing all of them.

For example, Japan Kokai Tokkyo Koho JP 62130238 A2, published Jun. 12, 1987 (Chem. Abstr. 108:99467), discloses an alloy containing Pt 85–95%, Si 1.5–6.5%, and Pd, Cu, Ir, Au, Ag, Ni, Co and/or Rh for the balance. This alloy has a white platinum color useful in jewelry such as rings, tiepins and watch cases.

Japan Kokai Tokkyo Koho JP 03100159 A2, published April 25, 19U 1 (Chem. Abstr. 116:45112), discloses a metal combination that exhibits a bright black finish rather than a desirable enhanced white finish. The composition of the reference includes: Pt, Rh 3–15%, and/or Ru and ≦15% of Pd, Ir, Os, Au, Ag, Cu and/or Ni. These materials are heated in air or an oxidizing atmosphere at temperatures below the melting point of the alloys and then quenched in air, water or oil to generate a bright black finish.

Japan Kokai Tokkyo Koho JP 02043333 A2, published Feb. 1 1990 (Chem. Abstr. 113:63801), provides an alloy useful in jewelry manufacture containing Pt 80–98%, Re 0.5–10%, Pd 1–19% and Ru, Rh and/or Ir 0.05–3%, which is said to have improved hardness and castability.

Tucillo (U.S. Pat. No. 3,767,391) discloses a tarnish-resistant alloy useful in cast or wrought dental work and in the manufacture of jewelry, which comprises 47% gold, 9–12% Pd, and the balance silver and copper. Due to the presence of gold, Tucillo's alloys are primarily yellow in coloration and not white.

Japan Kokai Tokkyo Koho JP 07011362 A2, published Jan. 13, 1995 (Chem. Abstr. 122:271622), discloses alloys useful in jewelry applications with Pd≧80%, Co 1–5% and Pt 5–15% which are said to have high hardness, formability and corrosion resistance, and do not require coatings.

It is generally known to plate platinum (Pt) with rhodium (Rh) to achieve a desired appearance for jewelry. However, a plated platinum coating is not durable over time, i.e., the coating wears off, and the base material does not exhibit the desired properties noted above, presenting poor appearance after such wear.

None of the above prior art alloys meets the requirements of stable, long-term whiteness, strength, and malleability, combined with ease of preparation. The present inventor recognizes a need for metal alloy compositions for use in jewelry which retain exceptional whiteness without requiring a rhodium plating process while providing desirable mechanical properties for jewelry.

SUMMARY OF THE INVENTION

The composition according to the present invention provides an alloy composition comprising platinum, rhodium and ruthenium which surprisingly retains an enhanced white finish without the need for further processing. The alloy compositions according to the present invention exhibit enhanced whiteness in comparison to platinum alloys available in the art. The present alloy compositions also possess the significant operational advantage of not requiring rhodium plating to achieve an acceptable whiteness, thereby substantially increasing the ease of making the alloy, and simultaneously reducing the cost of preparing jewelry casts and settings.

An object of the invention is to provide an aesthetic jewelry item comprising a platinum alloy having a durable high reflectance and a white finish comprising platinum, rhodium and ruthenium.

Another object is to form a platinum alloy having a permanent white finish, being highly workable, ductile and strong.

An alloy according to the present invention having a desired white finish comprises platinum present at a concentration of about 95% by weight, rhodium present in a concentration of from about 2.5% to about 3.5% by weight and ruthenium being present at a concentration from about 1.5% to about 2.5% by weight.

In one aspect, an aesthetic jewelry item comprises the platinum alloy as described above.

In a further aspect, the jewelry item is selected from the group consisting of a ring, a brooch, a clip or a watch casing.

In a still further aspect, a method of making the alloy comprises melting platinum shot having a particle size of up to about 3 mm diameter combined with powdered Rh and Ru sponge material.

The method may including remelting the alloy a plurality of times to homogenize the alloy and quenching the melted alloy in flowing water at room temperature.

Preferably, the melting of the alloy is performed in a reduced pressure atmosphere.

IN THE DRAWING

FIGS. 1–3 are charts illustrating various tested properties of the alloy according to an embodiment of the present invention.

DETAILED DESCRIPTION OF THE PREFERRED EMBODIMENTS

Figure 1:
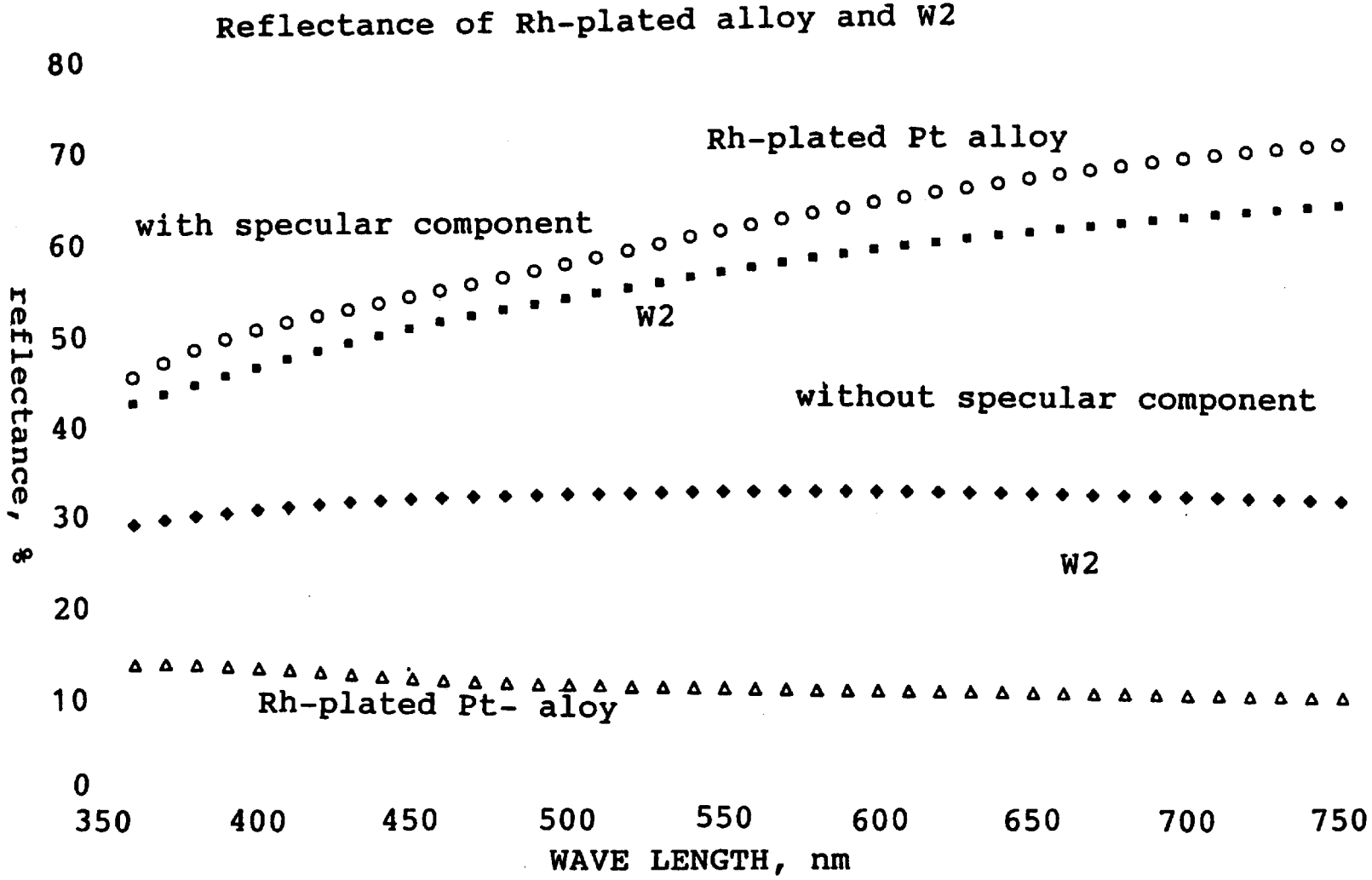

The alloy of the present invention provides aesthetic pleasing jewelry comprising an alloy of about 95% platinum, about 2.5 to 3.5% rhodium and about 1.5 to 2.5% ruthenium, as disclosed herein, for use in jewelry items such as rings, brooches, bracelets, clips or watch cases, for example.

The melting processes required to prepare the platinum alloy described herein may be carried out using any heat-generating apparatus suited to the purpose. Such an apparatus may encompass an induction furnace, an arc melt furnace or high-frequency melting furnace provided with a crucible and a gas atmosphere which may either be a normal mixture of atmospheric gases or an inert gas. The furnace atmosphere is preferably at reduced pressure. This setup allows quenching.

Quenching is preferably carried out employing flowing water at room temperature, e.g., tap water. Preferably the alloy may be made with platinum shot comprising commercially available 1–3 mm diameter particles combined with rhodium and rhutenium powder formed from Rh and Ru sponge ground into a powder also commercially available. Grinding the solid sponge material of the specified elements forms the sponge powder.

The alloys prepared in accordance with the present invention are unexpectedly stronger than pure platinum, and unexpectedly, significantly and permanently whiter in color than either pure platinum or platinum rhodium plated substrates of the prior art.

The present invention will be better understood from the following examples. However, one skilled in the art will readily appreciate that the specific methods and results discussed are merely illustrative. All parts and percentages are given by weight unless otherwise indicated.

EXAMPLE 1 (Alloy W1)

Platinum shot (course particles 1–3 mm diameter) was placed over Rh and Ru sponge powder comprising porous solid spongy material, a chemical precipitation, which was ground into a powder (all purchased from Johnson Matthey). Total weight of the charge 2 TR. OZ. (62.2 g). The platinum comprised about 95%, the Rh comprised embodiment about 2.5% and the Ru comprised about 2.5% of the charge by weight.

The charge was melted in a fused quartz crucible placed in a ceramic flask. The alloy was melted at a temperature of 2050° C. in an induction furnace chamber with a negative pressure (low vacuum). The melting temperature 2050° C. of the resulting alloy (W1) 95%Pt—2.5% Rh—2.5% Ru was determined using a Raytek optical pyrometer.

The time to achieve the desired melt was about 1 minute and the melt was held at the melt temperature for about 12 seconds. The melting was repeated three (3) times to homogenize the alloy.

The alloy was quenched after melting in running tap water at room temperature 60–70° F. The flask with the crucible was placed into the running water after the furnace power was switched off.

The resulting alloy W1 was centrifugally cast in Erscem induction casting machine into a mold with a 2" long and ¼" diameter cavity as well cast into a hemispherical button 1" diameter and ¼" thick. The temperature of the melt was 2050° C.

The resulting W1 alloy (about 95%Pt—about 2.5% Rh—about 2.5% Ru) was tested for hardness and was considered too hard and its workability was inferior for most jewelry applications.

EXAMPLE 2 (Alloy W2)

Alloy W1 was modified by diluting its Ru content to about 1.5% by adding Pt of an appropriate amount of Pt shot and increasing the Rh content to about 3.5% by adding an appropriate amount of Rh powder producing a second alloy (W2) in accordance with the procedure of Example 1.

The W2 composition containing 95% Pt—3.5% Rh—1.5% Ru was centrifugally cast in Erscem induction casting machine into molds with 2" long and ¼" diameter cavity. It was also cast hemispherical button 1" diameter and ¼" thick. This alloy exhibited desirable mechanical properties as shown below by detailed testing.

EXAMPLE 3 (Alloy W3)

A third composition (W3) was prepared according to the procedure of Example 1. Alloy W3 contained about 95% Pt—about 3% Rh—about 2% Ru. Alloy W3 did not appear as lustrous as the W2 alloy, which exhibited the best combination of properties for jewelry applications.

Alloy Characteristics W2

Alloy W2, which exhibited the best combination of properties, was further tested. Results of this material testing are presented below.

Additional tests were performed on the W2 alloy, which was re-melted in a Wesgo quartz melting dish. The melting was carried out by torch, "natural" working conditions. The material was hot hammered to remove bubbles and the resulting 1" diameter by ¼" thick button was cold rolled into 2 mm thick plate. A plate was cold rolled from the cast button. Samples 20×20 mm were cut from the plate. The remaining material was remelted in the dish, and hammering hot formed a billet about 10 mm diameter and then cold rolled to a ⅛ inch diagonal octagon cross section rod. The reduction of the plates and rod by hammering did not exceed about 50%.

Figure 2:
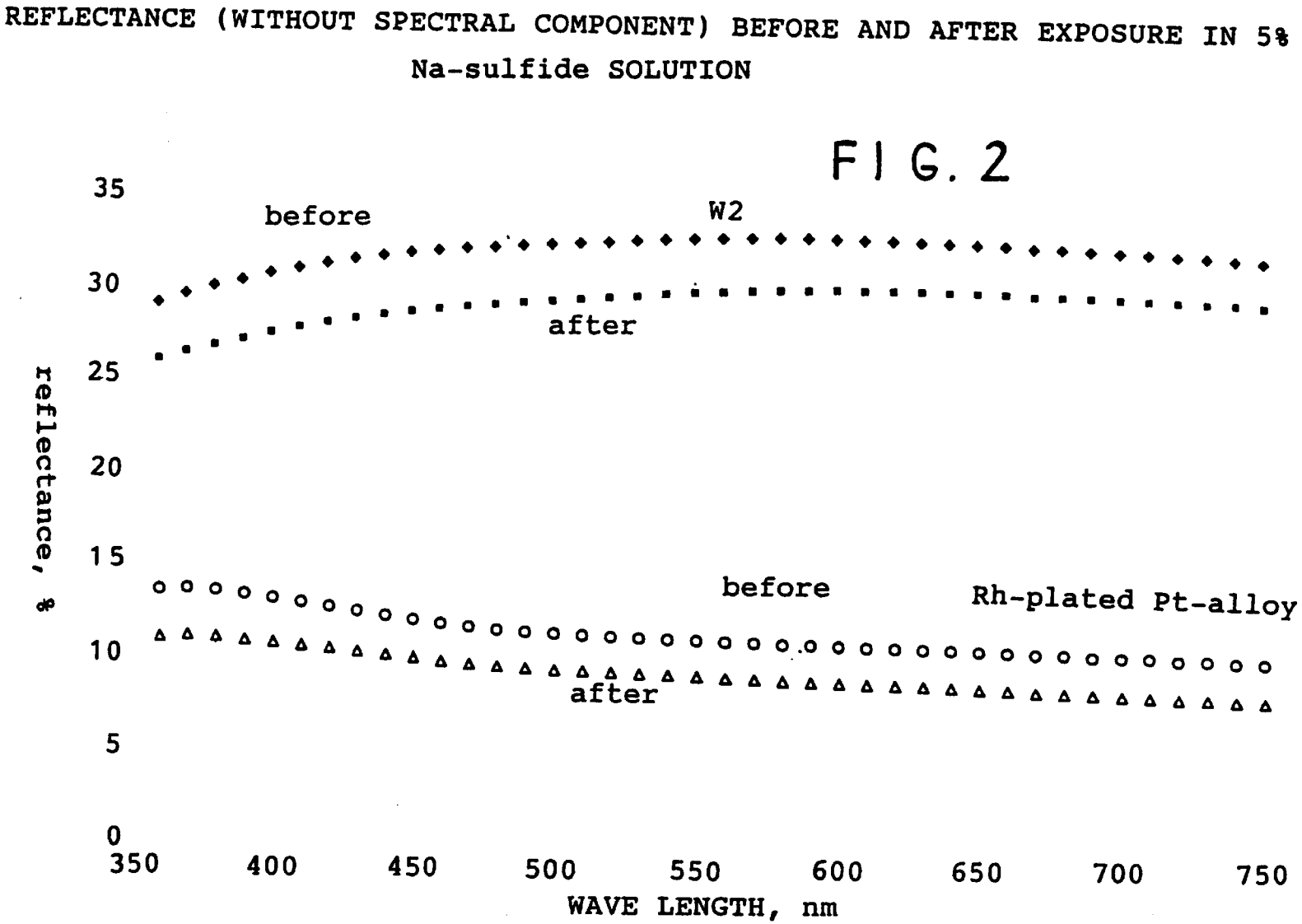
Figure 3:
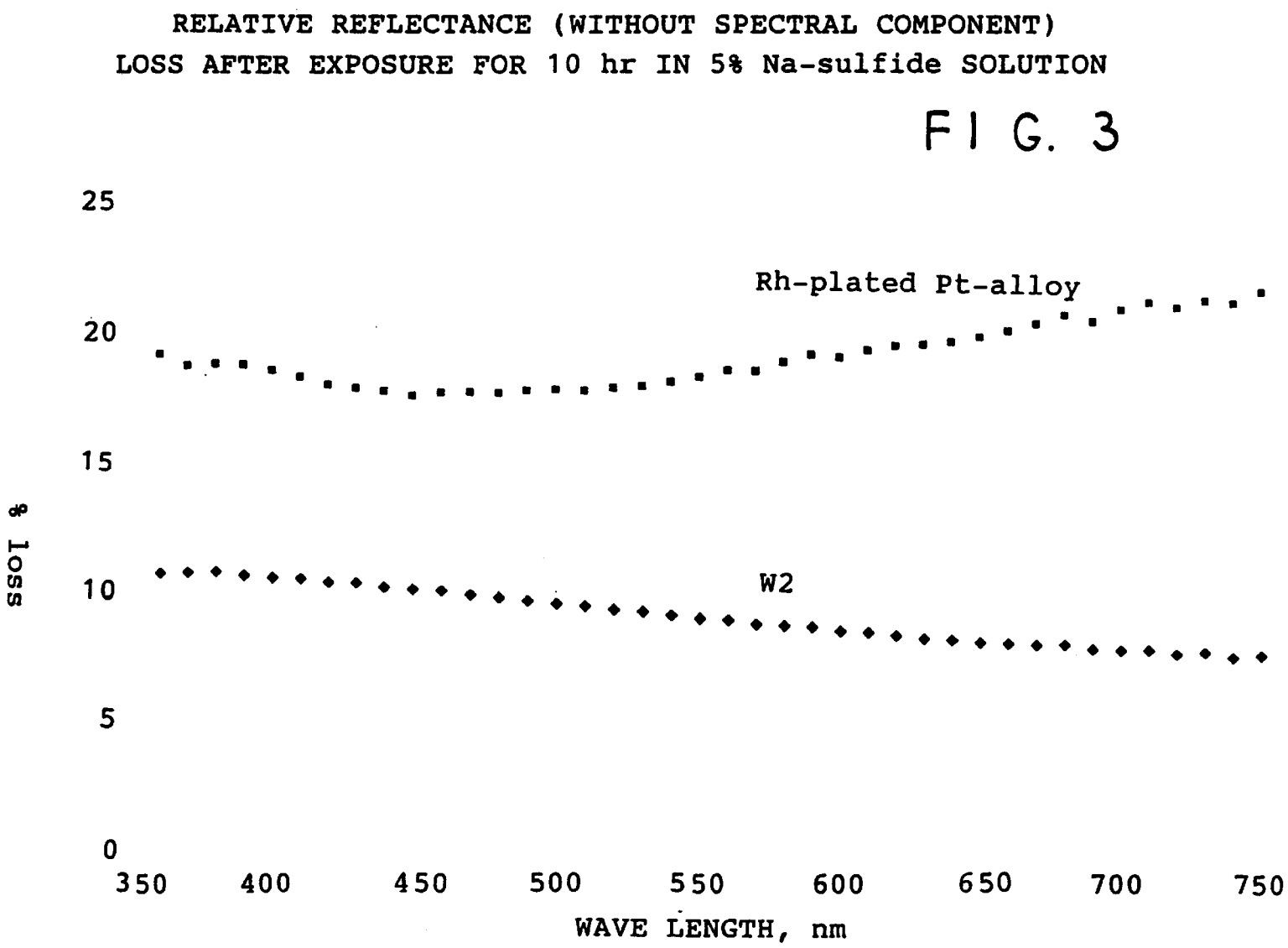

The following tests were conducted:

1. Tensile strength before and after Annealing at 1550° F.
3. Microstructure observed before and after annealing in the direction of rolling and the transverse direction.
4. Hardness before and after annealing rods and plates.
5. Reflectance with "True color" (Reflectance without spectral component), shown in FIGS. 1–3.
6. Whiteness and whiteness index before and after exposure in tarnishing solution.

Mechanical Characteristics

Hardness of the plates and rods of the alloy W2 of Example 2 was measured from the plates on a Rockwell F and 15T scales and for the rods on a 15T scale. For rods, hardness, tensile strength, and microstructure were determined in as rolled and in an annealed condition.

Hardness

Hardness, Table 1, was measured on a Rockwell Hardness Tester. The results for the plates on the Rockwell F (60 kg 1/16" steel ball) and 15T (15 kg 1/16" steel ball) scales are in a good agreement.

TABLE 1

| | Hardness | | | |
|---|---|---|---|---|
| SAMPLE | HRF | 15T | 15T | *HRB |
| Plate I rolled about 50% reduction | 70 | 67 | 67 | 21.5 |
| Plate 2 rolled about 50% reduction | 71.2 | 67.2 | 67.2 | 23 |
| Rod Rolled about 40% reduction | | | 64.2 | 15 |
| Rod Annealed | | | 59 | |

*- conversion from ASTM hardness tables

Table 1 shows good hardness properties for jewelry applications.

Tensile Characteristics

Tensile characteristics were measured on Instron tensile machine. A ⅛" diagonal octagon cross-section rod—4" long were used for testing. Tensile testing results are shown in Table 2.

TABLE 2

| SAMPLE | YS, ksi (Mpa) Yield strength | UTS, ultimate tensile strength ksi (Mpa) | EL, % (50 mm) elongation |
|---|---|---|---|
| Tensile Test | | | |
| Rod Rolled about 50% reduction | 48.0(330) | 51.1(351) | 11.0 |
| Rod Annealed | — | 49.5(340) | 18.0 |

The tensile test shows good tensile properties for the W2 alloy for jewelry applications.

Table 3 shows comparison of the W2 mechanical characteristics with typical properties of binary Pt-Rh and Pt-Ru alloys of 95% Pt.

TABLE 3

| ALLOY | YS, Mpa (ksi) | UTS, Mpa (ksi) | EL, % (50 mm) | Hardn 15T |
|---|---|---|---|---|
| Pt 99.9 annealed | | 124–165 | 30–40 | <50 |
| Pt 99.9 hard | | 207–241 | 1–3 | 72 |
| W2 annealed | | 340(49.5) | 18.0 | 54 |
| W2 hard about 50% | 330(48) | 351(51.1) | 11.0 | 68.0 |
| W2 hard 85% | 316(46) | 331(48.2) | 21.2 | 92.3 |
| Pt-3.5Rh annealed | | 170(25) | 35 | 62.5 |
| Pt-3.5Rh hard | | 415(60) | | 83 |
| Pt-5Rh annealed | | 205(30) | 35 | 72 |
| Pt-5Rh hard | | 485(70) | | |
| Pt-5Ru annealed | | 415(60) | 34 | 72 |
| Pt-5Ru hard | | 795(115) | 2 | 86 |

Table 3 shows that the new allow W2 exhibits improved mechanical properties relative to the Pt and Ru or Pt and Rh compositions, minimum elongation and optimum UTS and optimum hardness.

TABLE 4

| Alloy | Hardness 15T |
|---|---|
| W2 Cast hemispherical button | 61.5 =/− 1.5 |
| W2 Cylindrical cast rod | 69.5 +/− 2.0 |
| W2 Cold formed Square Rod | 83.8 +/− 1.1 |

Table 4 shows the properties for the as cast alloy. Hardness was measured for the platinum alloy samples by using the 15T scale (15 kg load, 1/16 inch diameter in diameter). The average hardness values for the un-annealed and annealed samples were 65 and 59 units in the 15T scale, respectively.

The (in un-annealed condition W2H) and annealed platinum alloy samples W2A were mechanically tested in an Instron tensile machine. No machining was performed on the samples. The following Table 5 contains the results of the tensile tests.

TABLE 5

| Property | W2A | W2H |
|---|---|---|
| Yield Strength (psi) | N/A* | 48,000 |
| Tensile Strength (psi) | 49,500 | 51,100 |
| % Elongation in 2 inches | 18.0 | 11.0 |

*The yield strength of the "W2A" sample is not available because the sample slipped from the grips of the tensile machine during testing.

Microstructure

The microstructure for the as rolled and annealed condition of the W2 alloy was examined. Longitudinal and transversal microspecimens of the alloy material were prepared using standard metallographic procedure. The microspecimens were etched with a 3:1 ratio of HCL and HN03 in aqua regia at boiling temperature for 45 minutes.

The sample labeled "WRA" was annealed in a temperature of 1550° F. for 1 hour. Longitudinal and transversal microspecimens of the annealed platinum alloy were prepared and etched with the aforementioned etchant.

It was observed to have typical elongated grains before annealing, and some degree of recrystallization was observed after annealing at 1550° F. No unusual grain characteristics were observed. The observed structure was deemed acceptable.

No significance was attached to the different microstructures.

Optical Characteristics and Tarnishing

Optical characteristics of the W2 alloy were compared with those for Rh plated platinum substrate. See FIGS. 1–3.

Reflectance with (specular) and without (diffuse-true) the specular component was determined, FIG. 1. Whiteness (brightness) of the surfaces was compared by measuring the L parameter. Specular properties are primarily a function of surface smoothness and these components were not compared in FIGS. 2 and 3.

Resistance to tarnishing was tested wherein Rh-plated and W2 samples were exposed for 10 hours in 5%—Sodium Sulfide aqueous solution for 10 hours. Reflectance and L parameters were compared with those before exposure, FIG. 2.

The optical characteristics were determined using a Macbeth Color Eye 7000 spectrophotometer (Kollmorgen Corp.)

Illuminant: D65 (Northern Sky Daylight)
Mode: Reflectance
Wavelength: 360–750 nm
Observer Angle: 10°
Equation: CIE L,a,b
Calibration Standard:Barium Sulfate Tile Table 6 shows the change in whiteness (brightness) after exposure in 5% Sodium Sulfide aqueous solution for 10 hours, see also FIG. 2.

TABLE 6

| SAMPLE | $L_0$ | $L_{tm}$ | ΔL, % |
|---|---|---|---|
| W2 | 63.6 | 62 | −2.5 |
| Rh-PLATED | 38.9 | 35 | −10.0 |

The whiteness (brightness) number L for W2 after the exposure decreased only by 2.5% compared with 10% for the rhodium coated sample, indicating that the W2 alloy was less affected (less tarnished) by the exposure.

Whiteness Ganz indexes for both Rh-plated and W2 alloys are smaller than 100, Table 7, indicating that color of the alloys is a yellowish white.

TABLE 7

| SAMPLE | CIE Ganz 82 before test | CIE Ganz 82 After tarnish test |
|---|---|---|
| W2 | 25.95 | 19.9 |
| Rh-plated | 38.24 | 38.9 |

Reflectance with specular component is indication of the surface smoothness condition and reflectance without specular component indicates the true color of the metal. The surface of the W2 alloy was not as smooth as that of coated material and, therefore, the reflectance was slightly lower. The surface smoothness is a function of mechanical finishing which is believed not a true characteristic of a given alloy. For example, the reflectance without the spectral component was significantly higher (about 3 times) for the W2 alloy.

After the tarnishing test, the reflectance loss for measurement without the specular component was measured to be about 2 times higher for the plated sample compared with the W2 alloy.

The above testing shows that the new alloy W2 has improved mechanical and optical properties optimum for jewelry applications, and has exceptional resistance to tarnishing.

It will occur to one of ordinary skill that modifications may be made to the disclosed embodiments, which are given by way of illustration and not limitation. It is intended that the appended claims define the invention. For example, while specific relative percentages of material were produced in the examples, variations of these values are believed to provide desirable compositions for jewelry. That is, the relative proportions may vary somewhat from those demonstrated in the examples in accordance with a given implementation.

What is claimed is:

1. An alloy having a white finish consisting essentially of platinum present at a concentration of about 95% by weight, rhodium present in a concentration of from about 2.5% to about 3.5% by weight and ruthenium being present at a concentration from about 1.5% to about 2.5% by weight.

2. An aesthetic jewelry item comprising the platinum alloy of claim 1.

3. The aesthetic jewelry item of claim 2 wherein the item is selected from the group consisting of a ring, a brooch, a clip or a watch casing.

4. A method of making the alloy of claim 1 comprising melting platinum shot having a particle size of up to about 3 mm combined with powdered Rh and Ru sponge material.

5. The method of claim 4 including remelting the alloy a plurality of times to homogenize the alloy and quenching the melted alloy in flowing water at room temperature.

6. The method of claim 4 where the melting occurs in an atmosphere of reduced pressure.

7. An alloy consisting essentially of platinum present at a concentration of about 95% by weight, rhodium present in a concentration of about 3.5% by weight and ruthenium being present at a concentration of about 1.5% by weight.

* * * * *